US009728360B2

(12) United States Patent
Birner et al.

(10) Patent No.: US 9,728,360 B2
(45) Date of Patent: Aug. 8, 2017

(54) POWER RELAY FOR A VEHICLE

(71) Applicant: ELLENBERGER & POENSGEN GMBH, Altdorf (DE)

(72) Inventors: Markus Birner, Zirndorf (DE); Manuel Engewald, Nuremberg (DE); Helmut Kraus, Berg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 15/135,827

(22) Filed: Apr. 22, 2016

(65) Prior Publication Data

US 2016/0314925 A1 Oct. 27, 2016

(30) Foreign Application Priority Data

Apr. 22, 2015 (DE) ..... 10 2015 207 360

(51) Int. Cl.
*H01H 1/00* (2006.01)
*H01H 50/54* (2006.01)
(Continued)

(52) U.S. Cl.
CPC ..... *H01H 50/546* (2013.01); *H01H 50/04* (2013.01); *H01H 51/065* (2013.01);
(Continued)

(58) Field of Classification Search
CPC ..... H01H 33/18; H01H 50/06; H01H 50/54; H01H 2205/002; H01H 1/06; H01H 1/12;
(Continued)

(56) References Cited

U.S. PATENT DOCUMENTS 5,424,700 A * 6/1995 Santarelli ..... H01H 51/065 335/126
8,269,585 B2 * 9/2012 Choi ..... H01H 1/2008 335/126
(Continued)

FOREIGN PATENT DOCUMENTS

DE 3329617 A1 3/1984
DE 19755930 A1 6/1999
(Continued)

*Primary Examiner* — Shawki S Ismail
*Assistant Examiner* — Lisa Homza
(74) *Attorney, Agent, or Firm* — Laurence A. Greenberg; Werner H. Stemer; Ralph E. Locher

(57) ABSTRACT

A power relay for a vehicle has a housing and two connecting bolts that are introduced into the housing so as to contact a load current circuit. The power relay further having a coil assembly that is arranged in the housing, the coil assembly contains a magnetic coil and a magnetic armature that is coupled by way of a force-transferring member to a contact bridge that can be moved in a reversible manner between a closed position and an opened position and can be displaced in the housing under the effect of a magnetic field that is generated by the magnetic coil. The contact bridge supports two contact elements that together with the mating contacts of the connecting pin form a first contact pair and a second contact pair. The contact pairs form a three point bearing arrangement in the closed position.

9 Claims, 5 Drawing Sheets

(51) Int. Cl.

| | |
|---|---|
| ***H01H 51/06*** | (2006.01) |
| ***H01H 50/04*** | (2006.01) |
| ***H01H 51/22*** | (2006.01) |
| *H01H 1/20* | (2006.01) |
| *H01H 1/50* | (2006.01) |

(52) U.S. Cl.
CPC ..... *H01H 51/2209* (2013.01); *H01H 1/20* (2013.01); *H01H 1/50* (2013.01); *H01H 2203/024* (2013.01)

(58) Field of Classification Search
CPC ..... H01H 1/58; H01H 2235/012; H01H 2201/00; H01H 2203/00; H01H 2203/024; H01H 2203/026; H01H 2205/016–2205/038; H01H 9/04; H01H 1/10; H01H 1/14; H01H 1/20; H01H 50/546
USPC ..... 335/196
See application file for complete search history.

(56) References Cited

U.S. PATENT DOCUMENTS 8,289,110 B2 * 10/2012 Niimi ..... F02N 11/087 335/126
8,947,183 B2 2/2015 Yano et al.
2007/0241847 A1 * 10/2007 Yamamoto ..... H01H 50/305 335/196
2011/0001589 A1 * 1/2011 Usami ..... H01H 50/14 335/196
2011/0267157 A1 11/2011 Kalmbach et al.
2013/0021121 A1 1/2013 Uchida
2013/0057369 A1 * 3/2013 Yano ..... H01H 1/66 335/156
2013/0193110 A1 * 8/2013 Hoehne ..... H01H 1/06 218/146
2013/0214884 A1 * 8/2013 Ito ..... H01H 1/20 335/153
2013/0342293 A1 * 12/2013 Yamamoto ..... H01H 1/32 335/194
2014/0232489 A1 * 8/2014 Kubono ..... H01H 50/54 335/83
2015/0187518 A1 * 7/2015 Molyneux ..... H01H 1/06 335/154
2015/0213982 A1 * 7/2015 Lim ..... H01H 1/54 335/185
2015/0303016 A1 * 10/2015 Sprague ..... H01H 1/06 335/189
2016/0042881 A1 * 2/2016 Nishida ..... H01H 1/06 335/196
2016/0093458 A1 * 3/2016 An ..... H01H 50/38 335/136
2016/0133404 A1 * 5/2016 Zhong ..... H01H 9/443 335/201
2016/0181038 A1 * 6/2016 Shimizu ..... H01H 50/44 335/165
2016/0233039 A1 * 8/2016 Kanematsu ..... H01H 1/66

FOREIGN PATENT DOCUMENTS

DE 29724595 U1 5/2002
DE 102010018738 A1 11/2011
EP 2549498 A1 1/2013
GB 1202713 A 8/1970
GB 2128030 A 4/1984
JP S5412957 U 1/1979

* cited by examiner

POWER RELAY FOR A VEHICLE

CROSS-REFERENCE TO RELATED APPLICATION

This application claims the priority, under 35 U.S.C. §119, of German application DE 10 2015 207 360.2, filed Apr. 22, 2015; the prior application is herewith incorporated by reference in its entirety.

BACKGROUND OF THE INVENTION

Field of the Invention

The invention relates to a power relay for a vehicle, in particular for a commercial vehicle. A power relay of this type is disclosed by way of example in DE 10 2010 018 738 A1, corresponding to U.S. patent publication No. 2011/02671587.

Power relays of the generic type are used in vehicle technology, in particular in the case of commercial vehicles. The power relays are used in order to electrically separate the vehicle battery from the vehicle electrical network. In addition, relays of this type are used in order to connect electrical motors of adjusting apparatus, for example a hydraulic pump or a lifting platform. It is necessary for a power relay of this type in the case of a low voltage of typically 12 volts to 24 volts to be able to connect currents up to a current strength of approximately 300 amps and therefore it is necessary to construct the power relay in an accordingly solid manner. Conventional relays that are used for this purpose are generally embodied from a pot-shaped metal body (for example iron or steel) and a magnetic coil and a magnetic yoke and also a magnetic armature that is connected to a contact bridge using a double contact are arranged in the metal body.

The power relay conventionally contains solid connecting bolts (threaded bolts) that are embodied from metal, the bolts typically containing a diameter of 0.5 cm to 1 cm so as to connect the power relay to a load current circuit that is to be connected in the vehicle. Cable lugs of the connecting lines of the load current circuit that is to be connected are fixed in accordance with their intended use in an electrically contacting manner to these connecting bolts by screw nuts (contact nuts).

In the installed state of the relay, in particular in a vehicle, by way of example in a truck, vibrations that are caused by operating the truck and are transferred to the power relay are practically unavoidable. This can lead to an undesired increase in the transition resistance between the moving contact bridge and the connecting bolts that are fixed to the housing. This problem could indeed be countered by increasing the contact pressure. However, this would require a stronger magnet system, which is not desirable.

SUMMARY OF THE INVENTION

The object of the invention is to provide a suitable power relay for a vehicle, in particular a commercial vehicle, with regard to a reliable contact arrangement.

The power relay contains a housing that is preferably formed from a housing pot and a connecting base and two connecting bolts are introduced into the housing for contacting a load current circuit. A coil assembly is arranged in the housing, the coil assembly comprising a magnetic coil and a magnetic armature that is coupled by way of a force transferring member to a contact bridge and can be displaced by the effect of a magnetic field that is generated in the housing by the magnetic coil.

The contact bridge can move in a reversible manner between a closed position, in which the contact bridge bridges the connecting bolts in an electrically conductive manner, and an opened position in which the contact bridge does not contact the connecting bolts. The contact bridge supports two contact elements that form a first and a second contact pair with mating contact elements of the connecting bolts that are hereunder also described as mating contacts, wherein in the closed position the contact pairs form a three point bearing arrangement or three point supporting arrangement. The mating contacts (mating contact elements) of the connecting bolts suitably comprise a planar bearing surface or supporting surface.

In an advantageous embodiment, the first contact pair is embodied in such a manner that the pair only contains a single, defined (local or locally delimited) bearing site (supporting site). The bearing site is suitably provided centrally in the contact bridge-side contact element of the first contact pair and is embodied in as punctiform a manner as possible with regards to the locally delimited bearing surface. This is suitably achieved in that the contact bridge-side contact element of the first contact pair contains a contact region that is slightly curved towards the bolt-side mating contact element in a convex manner. This is expediently produced by secant-type ground surfaces of the preferred plate-like contact element. Consequently, the convex contact region, in other words the region that is curved towards the exterior in relation to the contact surface, suitably extends in the bridge longitudinal direction while forming a raised central contact region so as to provide the bearing site along the contact bridge-side contact element.

In a further advantageous embodiment, the second contact pair is embodied in such a manner that the pair contains two defined bearing sites (supporting sites). In relation to the bolt-side mating contact element, the contact bridge side contact element of the second contact pair suitably contains an inwards-drawn contact region that is curved in a concave manner, in other words in relation to the contact surface. Expediently, the contact region that is curved in a concave manner extends in the bridge longitudinal direction along the contact bridge-side contact element. This embodiment is preferably likewise produced by means of a corresponding grinding process.

Other features which are considered as characteristic for the invention are set forth in the appended claims.

Although the invention is illustrated and described herein as embodied in a power relay for a vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
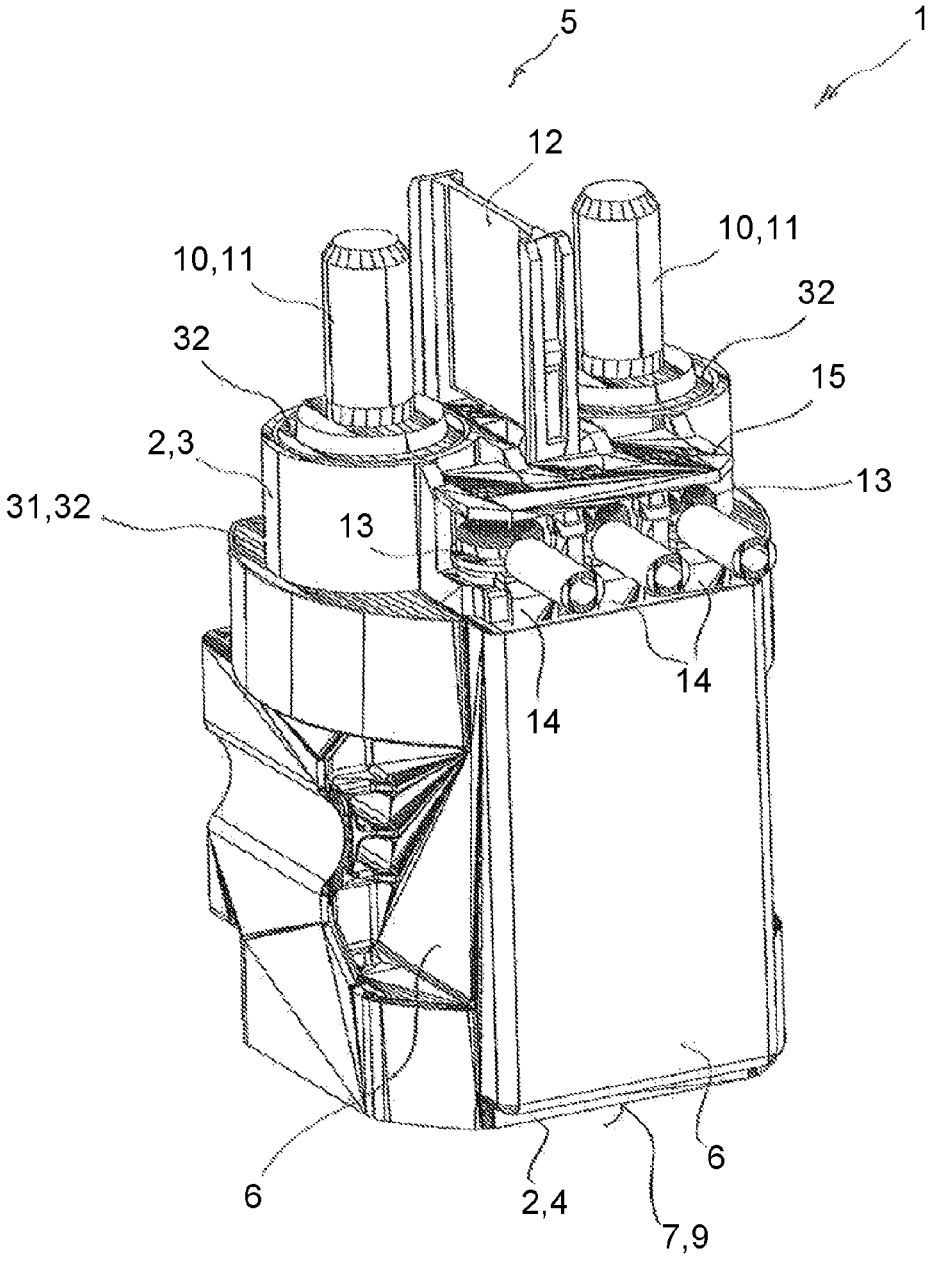
FIG. 1 is a perspective view inclined from above a power relay having a connecting base according to the invention.

Parts that correspond to one another are always provided with identical reference numerals in all the figures.

Figure 2:
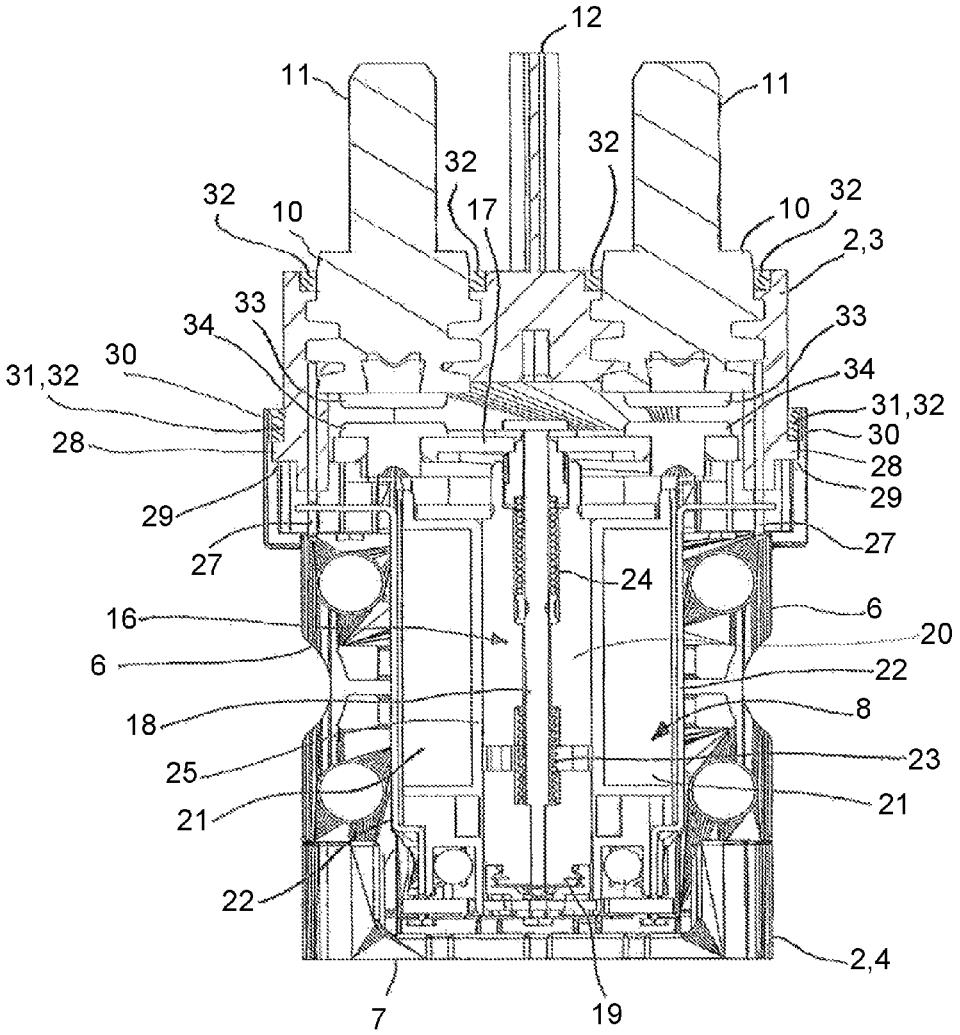
FIG. 2 is a longitudinal sectional view of the power relay with opened contacts and mating contact in the connecting base.

Referring now to the figures of the drawings in detail and first, particularly to FIGS. 1 and 2 thereof, there is shown a power relay 1 that contains a housing 2 that is formed from two parts, namely a connecting base 3 and a housing pot 4. Both the connecting base 3 and also the housing pot 4 are preferably formed as injection molded components from a synthetic material.

The connecting base 3 delimits the housing 2 on a connecting side and it is possible on the connecting side to contact the power relay 1 with an external load current circuit and also with external control lines. The connecting side is hereunder—irrespective of the actual orientation of the power relay 1 in the surrounding space—also described as an upper side 5. The housing pot 4 surrounds with four side walls 6 and a housing base 7 the remaining sides of an approximately cuboid-shaped housing interior 8 (FIG. 2). The housing base 7 closes the housing 2 on an underside 9 that is remote from the upper side 5, wherein the term "underside" is also used irrespective of the actual orientation of the power relay 1 in the surrounding space.

Two solid connecting bolts 10 are fixed in the connecting base 3 so as to connect the two connecting lines of the load current circuit that is to be connected, the connecting bolts protruding in each case with a threaded shaft 11 out the housing 2 towards the exterior. The connecting bolts 10 are solid rotary parts embodied from metal, the rotary parts containing by way of example a diameter of 0.8 cm in the region of the threaded shaft 11. An end side cable lug of this connecting line is attached to the allocated threaded shaft 11 and is contacted in a screwed manner by a screw nut (contact nut) so as to connect the respective connecting line of the load current circuit. As an alternative thereto, it is also possible for the connecting bolts 10 to be formed by sleeves having in each case a threaded hole. In lieu of contact nuts, contact screws are provided in this case for contacting the connecting lines, the contact screws being screwed in to the threaded holes. As is in particular evident in FIG. 2, the connecting bolts 10 are fixed in the connecting base 3 by injection molding with the synthetic material of the connecting base 3.

In order to avoid an electrical overload or other short circuit between the connecting bolts 10 and the connecting lines of the load current circuit, the connecting lines being fastened where appropriate to the connecting bolts, a dividing wall 12 is formed on the outer side on the connecting base 3, the dividing wall protruding into the intermediate space that is formed between the connecting bolts 10.

Furthermore, multiple (in this case in an exemplary manner three) signal terminals 13 are embodied on the connecting base 3 by way of which it is possible to contact in a screwed manner three correspondingly external control lines in each case with an end side cable lug to the power relay 1 so as to control the power relay 1, in other words to trigger switching processes by which the power relay 1 is switched on—by producing a housing-internal electrically conductive connection between the connecting bolts 10—or is switched off—by disconnecting the electrically conductive connection. Each signal terminal 13 is connected in an electrical manner by way of a connecting line 14 in the form of a curved stamped sheet metal part to the housing interior 8. The connecting conductors 14 are inserted between the connecting base 3 and the housing pot 4 or are likewise held in the connecting base 3 by injection molding. A separate synthetic cover 15 that can be latched on protects the signal terminals 13 towards the upper side 5 to prevent physical contact.

In addition to the above described housing parts, namely in addition to the connecting base 3 having the connecting bolts 10, which are fastened to the connecting base, and signal terminals 13 and also in addition to the housing pot 4, the power relay 1 contains a coil assembly 16 that is illustrated in FIG. 2. A conductor carrier in the form of a board that is populated with components of a control electronics system is likewise provided, however it is not visible in FIG. 2.

The coil assembly 16 that is illustrated contains a contact bridge 17 that is arranged in the inner region of the connecting base 3, the contact bridge being coupled in a mechanical manner by way of a coupling rod 18 to a magnetic armature 19 of the magnetic circuit. In addition to the magnetic armature 19, the magnetic circuit contains a magnetic yoke 20. The components that are not visible in a detailed manner are a central, hollow cylindrical core that surrounds the coupling rod 18 in a concentric manner, a U-shaped curved bracket and also two pole lugs that extend towards one another from the arm ends of the bracket, said pole lugs receiving the magnetic armature 19 between them. The magnetic armature 19 and the components of the magnetic yoke 20 are formed from ferromagnetic material.

Furthermore, the coil assembly 16 contains a magnetic coil 21 that lies in the volume that is framed by the magnetic yoke 20. The magnetic coil 21 surrounds the core of the magnetic yoke 20 in a concentric manner and is in turn framed by the bracket and the pole lugs. In addition, the coil assembly 16 contains two auxiliary conductors 22 that are formed in each case from a curved stamped sheet metal part, and two pressure resilient elements that surround the coupling rod 18, namely a return spring 23 and a contact pressure spring 24.

The above mentioned components of the coil assembly 20 are held together in a mechanical manner by a carrier body 25. The carrier body 25 is a single part, multifunctional injection molded component that is embodied from synthetic material. The carrier body 25 supports the magnetic coil 21 and holds the magnetic yoke 20 and the magnetic armature 19. The magnetic armature 19 and the core of the magnetic yoke 20 are received for this purpose in the interior of the carrier body 25. The magnetic armature 19 is mounted directly on the carrier body 20 in such a manner that it can slide.

The coil assembly 16 is clipped onto the connecting base 3 that is produced in an injection molding process. For this purpose, the connecting base 3 is provided on its underside with snap-in hooks 26 (FIG. 3) that are attached using an injection molding process.

The auxiliary conductors 22 are soldered to (voltage tap) connectors 27. The connectors 27 are allocated in pairs to the connecting bolts 10. One of the connectors 27 is consequently contacted by one of the connecting bolts 10 while the other connector 27 is contacted by the other connecting bolt 10. The connectors 27 are welded in advance for this purpose to the in each case allocated connecting bolt 10 and are injection molded together with said bolt to the synthetic material of the connecting base 3.

After assembling the coil assembly 16 and where appropriate the board on the connecting base 3, the housing pot 4 is placed over the coil assembly 16 and latched and screwed to the connecting base 3, whereby the housing 2 is closed. In the closed state of the housing 2, the connecting base 3 lies with a circumferential radial connecting piece 28 on a circumferential shoulder 29 in the wall of the housing pot 4. The housing pot 4 engages with a circumferential collar 30 that delimits the opening of the housing pot on the outer side around the radial connecting piece 28 of the connecting base 3 and protrudes beyond the connecting piece. The collar 30 consequently surrounds the upper side of the radial connecting piece 28 like a balustrade and forms together with the connecting base 3 a trough-shaped structure or trough 31. This trough 31 is filled with a casting compound 32 that is initially a fluid and hardens in the course of a hardening phase so as to seal the connection between the connecting base 3 and the housing pot 4 in a fluid and gas-tight manner. In particular, a two-component system of an epoxy resin and a mixed hardening agent is used as the casting compound 32.

Furthermore, the feedthroughs of the connecting lines 14 are sealed with the casting compound 32. The connecting lines 14 are guided for this purpose in the region of the trough 31 through the connecting base 3. The feedthroughs of the connecting bolts 10 through the connecting base 3 are sealed separately from the trough 31 by the casting compound 32.

The connecting bolts 10 in each case also form fixed contacts of the main switching device of the power relay 1, the switching device being provided so as to switch the load current circuit. The ends of the connecting bolts 10, the ends protruding out the underside of the connecting base 3 into the housing interior 8 are provided for this purpose in each case with a contact element that is hereunder described as the mating contact 33. The corresponding moving contact of the main switching device is formed by the contact bridge 17 that contains for this purpose in contrast to each mating contact 33 in each case a contact element 34 that is also described hereunder as a contact.

The contact elements 34 that are electrically short-circuited within the contact bridge 17 form in each case a contact pair 33, 34 with the opposite-lying mating contacts 33.

Figure 5:
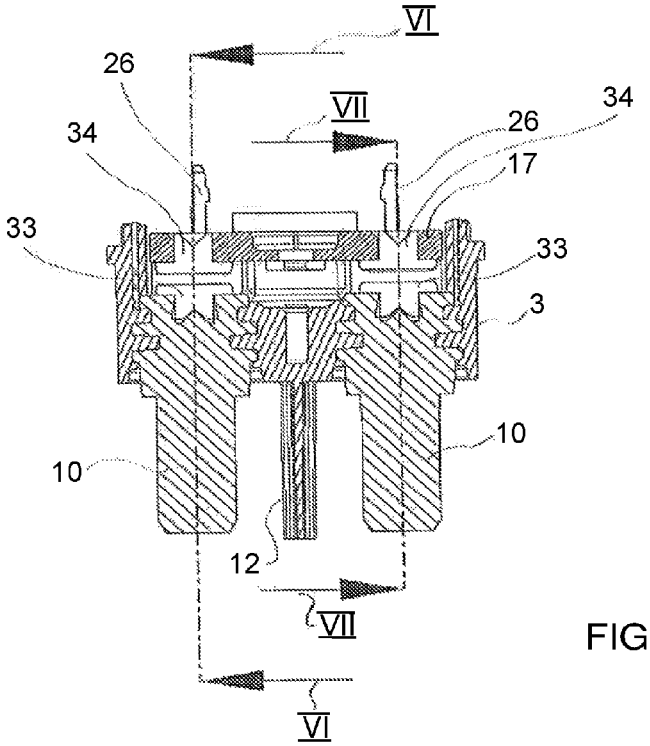
FIG. 5 is a sectional view of the connecting base.

FIG. 2—likewise FIG. 5—illustrates the power relay 1 in an opened position in which the contact elements 34 are raised by the mating contacts 33 (do not make contact) so that an electrically conductive connection is not produced between the connecting bolts 10. The magnetic coil 21 is energized in order to switch on the power relay 1. As a consequence, a magnetic flux is generated in the magnetic yoke 20 by which the magnetic armature 19 is drawn towards the core of the magnetic yoke 20. The contact bridge 17 is deflected upwards with the magnetic armature 19 while being conveyed by the coupling rod 18 so that the contact elements 34 impact against the corresponding mating contact elements 33. In the closed position of the power relay 1, the closed position being produced in this manner, a conductive connection is formed by way of the contact bridge 17 between the connecting bolts 10. The contact elements 34 and the mating contacts 33 that are arranged in each case lying opposite the contact elements form two contact pairs 33, 34.

The magnetic coil 21 is energized with a reversed polarization so as to switch off the power relay 1. Under the effect of the magnetic flux that is generated in the magnetic yoke 20, the holding force that is generated by permanent magnets is compensated so that the magnetic armature 19 is retracted by the return spring 23 from the core and consequently is pressed into the opened position. The magnetic armature 19 in turn brings the contact bridge 17 by way of the coupling rod 18, whereby the contact elements 34 no longer make contact with the corresponding mating contacts 33 when disconnecting the electrical connection between the contact bolts 10. A damping element that is attached to the lower end of the carrier body 25 can intercept this movement so that a spring back effect of the unit that is formed by the magnetic armature 19, the coupling rod 18 and the contact bridge 17 is prevented in the direction of the closed position.

In the illustrated bistable assembly of the power relay 1, each of the two switching positions of the power relay 1 is also stable in the non-energized state of the magnetic coil 21. It is only necessary to temporarily energize the magnetic coil 21. The control procedure of the magnetic coil 21 is performed either directly by way of the signal terminals 14 or by way of the control electronics system that controls the magnetic coil 21 in dependence upon external or internal control commands that are supplied to the control electronics system by way of the signal terminals 13. By way of the connectors 27, the control electronics system in addition determines in the switched on state of the power relay 1 the voltage that is dropping across the connecting bolts 10 as a measurement for the load current strength that is flowing through the power relay 1 or for identifying the relay position.

Figure 3:
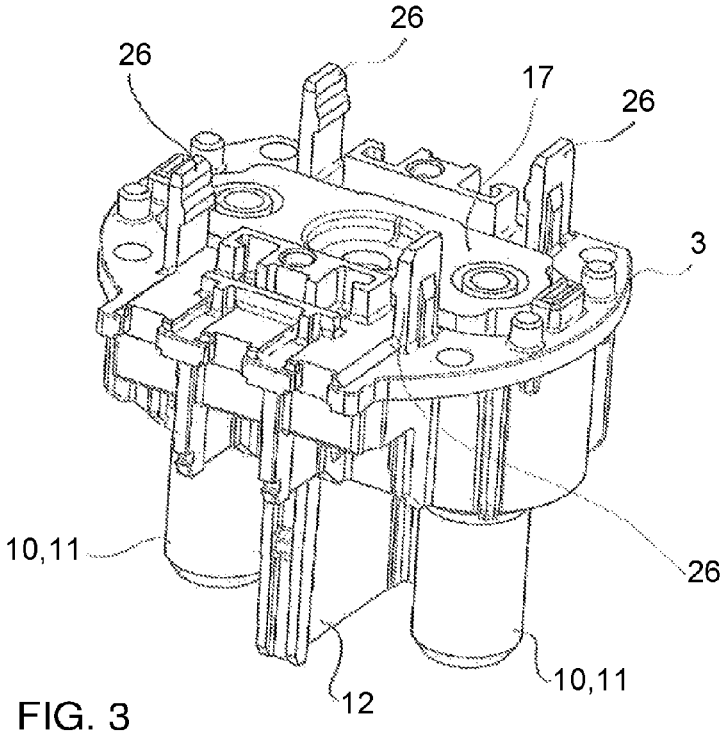
FIG. 3 is a perspective view of the connecting base with a view of a contact bridge that supports the contacts (contact elements)

FIG. 3 illustrates the connecting base in a position that is rotated with respect to that illustrated in FIG. 1 with a view of the contact bridge 17 that lies or sits in the connecting base without the coupling rod 18.

Figure 4:
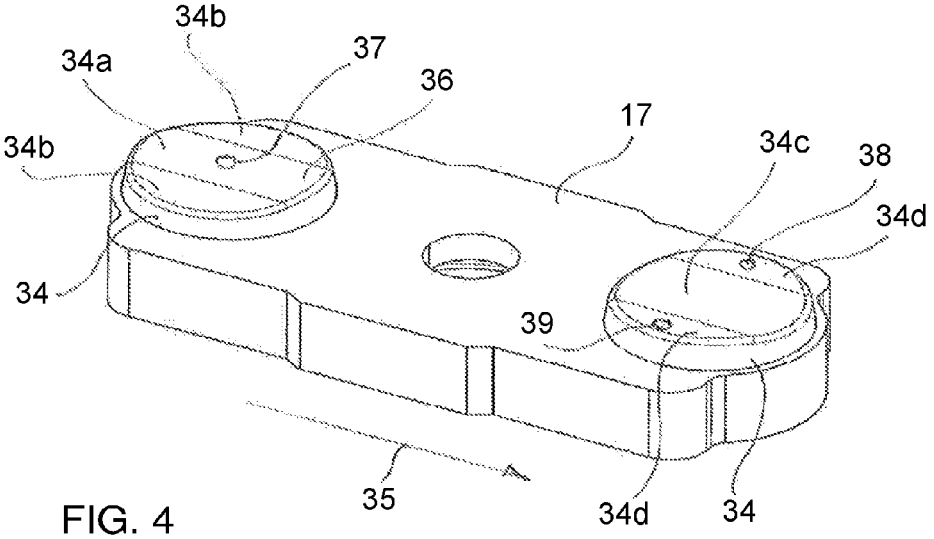
FIG. 4 is a perspective view of the contact bridge having contact elements that are embodied in a curved manner so as to form a three point bearing arrangement with the mating contacts.

FIG. 4 illustrates the contact bridge 17 in a position that is in turn rotated with respect to FIG. 3 with a view of the two contact elements 34. The left-hand side contact element 34 in FIG. 4 forms a first contact pair with the corresponding mating contact 33, while the right-hand contact element 34 in FIG. 4 forms a second contact pair with the corresponding mating contact 33. The contact element 34 of the first contact pair contains a contact region 34*a* that is curved in a convex manner and that extends in the longitudinal direction 35 of the contact bridge 17.

This curved (convex) contact region 34*a* is formed by way of example by corresponding, secant-type ground surfaces 34*b*—when viewed in a transverse manner with respect to the longitudinal direction 35—on the two sides of the outwardly curved contact region 34*a*. The shape of the outwardly curved contact region 34*a* is embodied in such a manner that in its central region and consequently in the middle region of the contact surface 36 of the contact element 34 a locally delimited, suitably practically punctiform bearing or support site 37 is formed.

The contact element 34 of the second contact pair contains a contact region 34*c* that likewise extends in the longitudinal direction 35 of the contact bridge 17 and is inwardly curved (in a concave manner). As a consequence,—in turn when viewed in a transverse manner with respect to the longitudinal direction 35—secant-type raised contact surface regions 34*d* are formed on the two sides of this contact region 34*c*, by way of example in turn by a suitable grinding technique. The contact surface regions 34*d* in turn form bearing or support sites 38, 39 that are preferably raised or exposed in the center or middle and that are likewise indicated for clarity in an identical manner to the defined bearing site 37 of the contact element 34 of the first contact pair with a small circle.

The contact elements 34 consequently form altogether on the contact bridge-side having the three bearing sites 37, 38, 39 a defined three point bearing arrangement of a three-point support arrangement with the two bolt-side mating contacts 33. An improved contact behavior is achieved with this construction even in the event of vibrations of the power circuit relay 1 in its intended installed state.

Figure 6:
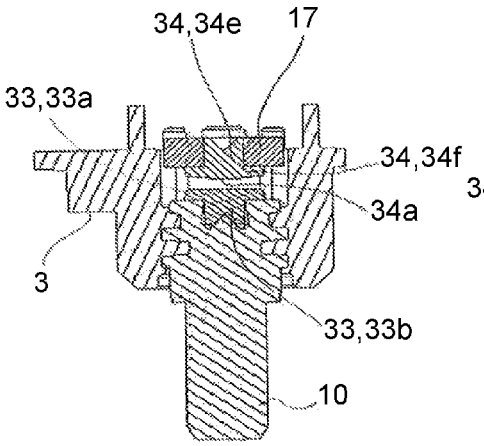
FIG. 6 is a sectional view taken along the line VI-VI shown in FIG. 5 having a contact bridge-side contact element that is curved outwards in a convex manner.
Figure 7:
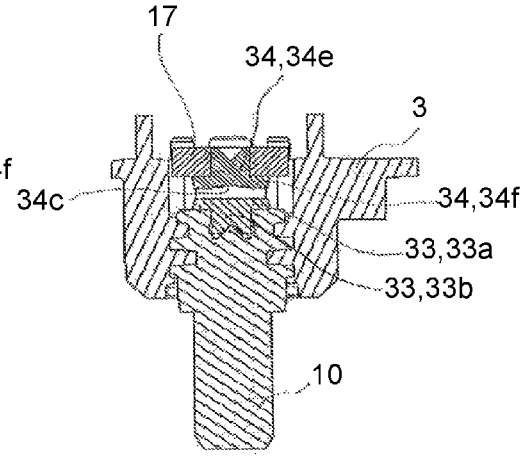
FIG. 7 is a sectional view taken along the line VII-VII shown in FIG. 5 having a contact bridge-side contact element that is inwardly curved in a concave manner.

FIG. 6 illustrates the contact bridge-side contact element 34 of the first contact pair having its contact region 34*a* that is outwardly curved in a convex manner so as to form the defined bearing site 37, while FIG. 7 illustrates the contact element 34 of the second contact pair with its contact region 34*c* that is inwardly curved when forming the further two defined bearing sites 38 and 39.

It is evident that the contact elements 34 and the mating contacts or mating contact elements 33 are embodied in a rivet-like manner. For this purpose, the mating contacts 33 contain a contact surface head 33*a* and a joining shaft 33*b*. The bridge-side contact elements 34 likewise comprise a joining shaft 34*e* and a contact surface head 34*f*. The mating contacts 33 are joined to the respective connecting bolt 10 by way of their joining shafts 33*b* and consequently fixedly connected to the connecting bolt. In a similar manner, the contact elements 34 are joined to the contact bridge 17 by way of their joining shafts 34*e* and consequently are fixedly connected to the contact bridge.

Figure 8:
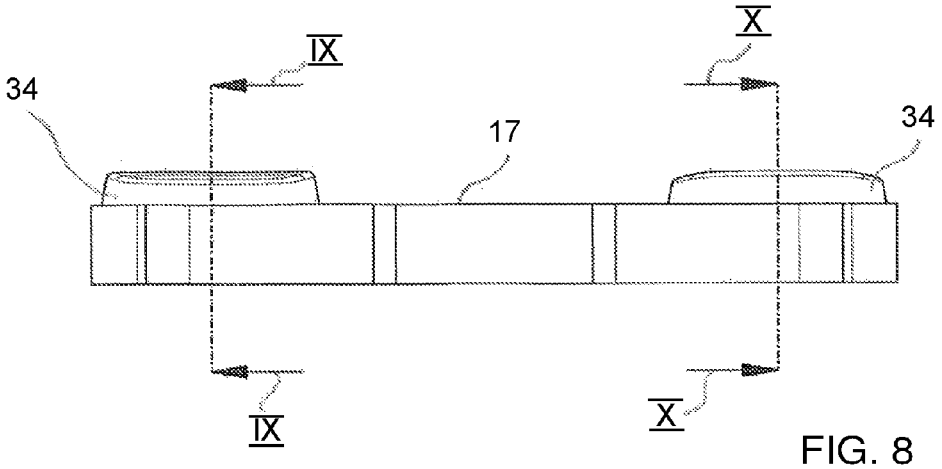
FIG. 8 is a side view of the contact bridge.
Figure 9:
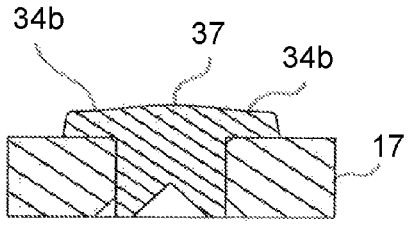
FIG. 9 is a sectional view taken along the line IX-IX shown in FIG. 8 along the contact element that is curved in a convex manner.
Figure 10:
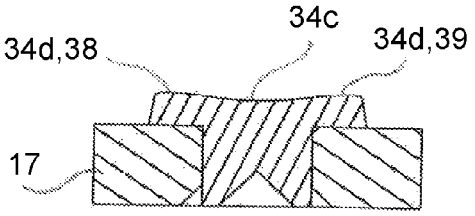
FIG. 10 is a sectional view taken along the line X-X shown in FIG. 8 along the contact element that is curved in a concave manner.

While FIG. 8 illustrates the contact bridge 17 in a side view, the FIGS. 9 and 10 illustrate sectional illustrations along or through the two contact elements 34. It is comparatively clearly evident that the contact element 34 of the first contact pair contains the contact region 34*a* that is outwardly curved in a convex manner. The shape of the outwardly curved contact region 34*a* leads in accordance with FIG. 9 to the fact that in the centered region of the contact surface 36 of the contact element 34 a locally delimited, punctiform bearing or support site 37 is formed. The contact element 34 of the second contact pair evidently contains the inwardly curved (concave) contact region 34*c*, whereby the raised contact surface regions 34*d* are formed on the two sides of the contact region 34*c*. These contact surface regions 34*d* form the exposed bearing or support sites 38, 39.

The following is a summary list of reference numerals and the corresponding structure used in the above description of the invention:

1 Power relay
2 Housing
3 Connecting base
4 Housing pot
5 Upper side
6 Side wall
7 Housing base
8 Housing interior
9 Underside
10 Connecting bolt
11 Thread shaft
12 Dividing wall
13 Signal terminal
14 Connecting conductor
15 Cover
16 Coil assembly
17 Contact bridge
18 Coupling rod
19 Magnetic armature
20 Magnetic yoke
21 Magnetic coil
22 Auxiliary conductor
23 Return spring
24 Contact pressure spring
25 Carrier body
26 Snap-in hook
27 (Voltage tap-) connector
28 Radial connecting piece
29 Shoulder
30 Collar
31 Trough
32 Casting compound
33 Bolt-side mating contact/mating contact element
33*a* Contact surface head
33*b* Joining shaft
34 Contact bridge-side contact element
34*a* (convex) contact region
34*b* Ground surface
34*c* (Concave) contact region
34*d* Raised contact surface region
34*e* Joining shaft
34*f* Contact surface head
35 Longitudinal direction
36 Contact surface
37 Bearing/support site
38 Bearing/support site
39 Bearing/support site

The invention claimed is:

1. A power relay for a vehicle, comprising:

a housing;

two connecting bolts introduced into said housing so as to contact a load current circuit and having mating contacts;

two contact elements;

a coil assembly disposed in said housing, said coil assembly having a force-transferring member, a contact bridge, a magnetic coil and a magnetic armature being coupled by way of said force-transferring member to said contact bridge that can be moved between a closed position and an opened position and also can be displaced in said housing under an effect of a magnetic field that is generated by said magnetic coil, said contact bridge supporting said two contact elements which form a first contact pair and a second contact pair with said mating contacts of said connecting bolts, wherein said first and second contact pairs form a three point bearing configuration in the closed position; and said first contact pair having a contact bridge-side contact element with a contact region being curved in a convex manner towards one of said mating contacts of said connecting bolts, said contact region being curved in said convex manner in a bridge longitudinal direction extends along said contact bridge-side contact element while forming a central, raised contact region so as to provide a bearing site.

2. The power relay according to claim 1, wherein said first contact pair is embodied in such a manner that said first contact pair contains only a defined bearing site.

3. The power relay according to claim 1, wherein said second contact pair is embodied in such a manner that said second contact pair contains two defined bearing sites.

4. The power relay according to claim 1, wherein at least one of said mating contacts or said contact elements has a joining shaft and a circular-shaped contact surface head.

5. The power relay according to claim 1, wherein said housing has a housing pot;

further comprising a connecting base being joined with said housing or can be in part inserted into said housing; and wherein said connecting bolts are introduced into said housing.

6. The power relay according to claim 5, wherein in an assembled state, said contact bridge sits at least in regions in said connecting base.

7. The power relay according to claim 1, wherein at least one of said mating contacts or said contact elements has a joining shaft and a plate-shaped contact surface head.

8. A power relay for a vehicle, comprising:

a housing;

two connecting bolts introduced into said housing so as to contact a load current circuit and having mating contacts;

two contact elements;

a coil assembly disposed in said housing, said coil assembly having a force-transferring member, a contact bridge, a magnetic coil and a magnetic armature being coupled by way of said force-transferring member to said contact bridge that can be moved between a closed position and an opened position and also can be displaced in said housing under an effect of a magnetic field that is generated by said magnetic coil, said contact bridge supporting said two contact elements which form a first contact pair and a second contact pair with said mating contacts of said connecting bolts, wherein said first and second contact pairs form a three point bearing configuration in the closed position; and said second contact pair containing a contact bridge-side contact element which has a contact region being inwardly curved in a concave manner in relation to one of said mating contacts of said connecting bolts, said contact region being inwardly curved in the concave manner in a bridge longitudinal direction extending along said contact bridge-side contact element while forming two raised contact regions that are adjacent thereto.

9. The power relay according to claim 8, wherein said one mating contact of said connecting bolts has a planar bearing surface.

* * * * *